US012698591B2

(12) United States Patent
Lindblom

(10) Patent No.: US 12,698,591 B2
(45) Date of Patent: Aug. 4, 2026

(54) BLADE FOR A REFINER FOR REFINING LIGNOCELLULOSIC MATERIAL, AND REFINER COMPRISING AT LEAST ONE BLADE

(71) Applicant: VALMET AB, Sundsvall (SE)

(72) Inventor: Thommy Lindblom, Hägersten (SE)

(73) Assignee: VALMET AB, Sundsvall (SE)

( * ) Notice: Subject to any disclaimer, the term of this patent is extended or adjusted under 35 U.S.C. 154(b) by 259 days.

(21) Appl. No.: 18/677,254

(22) Filed: May 29, 2024

(65) Prior Publication Data

US 2024/0426052 A1 Dec. 26, 2024

(30) Foreign Application Priority Data

Jun. 21, 2023 (SE) ..... 2330293-8

(51) Int. Cl.
*D21D 1/30* (2006.01)

(52) U.S. Cl.
CPC ..... *D21D 1/306* (2013.01)

(58) Field of Classification Search
CPC ..... D21D 1/30; D21D 1/303; D21D 1/306; B02C 7/12
See application file for complete search history.

(56) References Cited

U.S. PATENT DOCUMENTS 1,144,089 A * 6/1915 Alsted ..... B02C 7/06 241/296
1,705,379 A * 3/1929 Sheppard, Jr. ..... B02C 7/12 241/296
3,125,306 A * 3/1964 Kollberg et al. ..... D21D 1/306 241/300
6,032,888 A 3/2000 Deuchars
10,378,149 B2 * 8/2019 Lindblom ..... B02C 7/04
2008/0296419 A1 * 12/2008 Gingras ..... D21D 1/30 241/261.3

(Continued)

FOREIGN PATENT DOCUMENTS

BR 102022002744 A2 9/2022
CN 210856769 U 6/2020
CN 115516166 A 12/2022

OTHER PUBLICATIONS

Extended European Search Report issued in connection with EP Appl. No. 24176922.3 dated Nov. 22, 2024.

(Continued)

*Primary Examiner* — Bobby Yeonjin Kim
(74) *Attorney, Agent, or Firm* — Foley & Lardner LLP

(57) ABSTRACT

A blade for a refiner for refining lignocellulosic material is delimited by an inner periphery and an outer periphery and includes: a blade surface with a refiner portion on which a plurality of refiner bars are arranged, where: each refiner bar extends from an outer bar end to an inner bar end, and the plurality of refiner bars are arranged so that a movement along a bar extension from an outer bar end to an inner bar end of a refiner bar is also a movement in a first circumferential direction; and a dam that extends from an outer dam end to an inner dam end and connects at least three refiner bars, and wherein the dam is arranged so that a movement along a dam extension from an outer dam end to an inner dam end is also a movement in the first circumferential direction.

13 Claims, 5 Drawing Sheets

(56) References Cited

U.S. PATENT DOCUMENTS

Figure 1A:
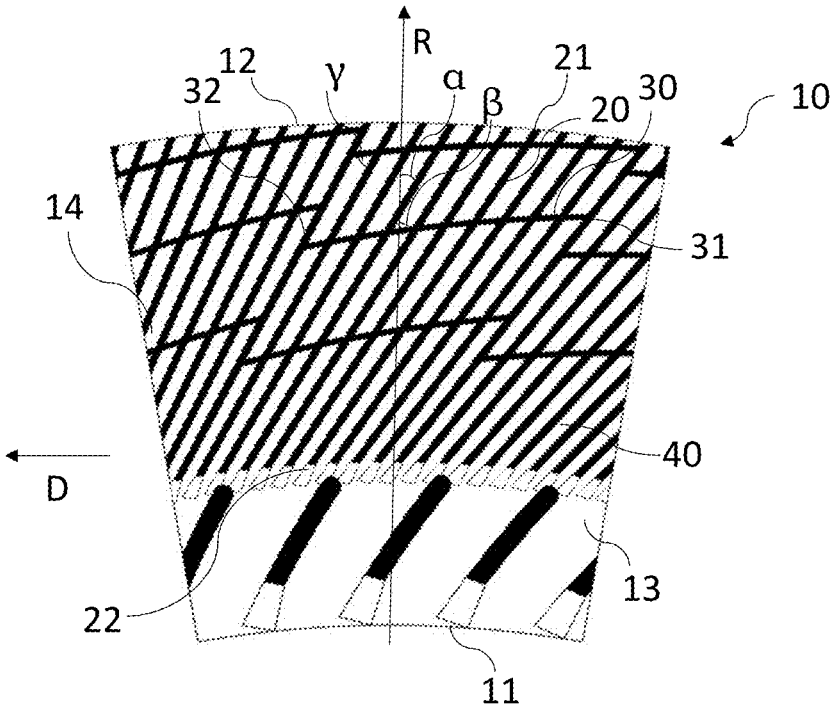

| | | | | |
|---|---|---|---|---|
| 2013/0270377 | A1* | 10/2013 | Gingras | D21D 1/306 241/220 |
| 2014/0110511 | A1* | 4/2014 | Antensteiner | D21D 1/306 241/261.3 |
| 2019/0071821 | A1* | 3/2019 | Lindblom | D21D 1/306 |
| 2019/0145048 | A1* | 5/2019 | Lindblom | D21D 1/306 162/261 |
| 2021/0222364 | A1* | 7/2021 | Olsson | B02C 7/12 |

OTHER PUBLICATIONS

Office Action issued in Chinese Appl. No. 202410800385.3 dated Dec. 30, 2025.
Extended European Search Report issued in connection with EP Appl. No. 24176876.1 dated Nov. 13, 2024.
Non-Final Office Action in U.S. Appl. No. 18/677,342 dated Apr. 16, 2026.

* cited by examiner

BLADE FOR A REFINER FOR REFINING LIGNOCELLULOSIC MATERIAL, AND REFINER COMPRISING AT LEAST ONE BLADE

CROSS-REFERENCE TO RELATED APPLICATIONS

This application claims priority to Swedish Patent Application No. 2330293-8, filed on Jun. 21, 2023, the entire contents of which are hereby incorporated by reference.

TECHNICAL FIELD

The present invention relates to refiner for refining lignocellulosic material during production of pulp, and to blades for such refiners.

BACKGROUND

A disc refiner is commonly used within the pulping industry for refining lignocellulosic material used in the production of fibrous material such as paper and board.

The disc refiner comprises two or more opposite refining elements, at least one of which is rotatable. The rotating refining element can be referred to as a rotor or a rotor side blade, whereas the non-rotating or stationary refining element can be referred to as a stator or a stator side blade. Between the refining elements is a refining gap, where the material to be refined is ground against the refining surfaces. The refining surface of the refining elements comprises refiner bars that serve to refine the lignocellulosic material during use, and also comprises dams that intersect the refiner bars and lift the lignocellulosic material towards the refining gap to ensure a thorough refining.

Refining lignocellulosic material is costly since the energy consumption is typically very high in order to reach the desired fiber quality. There are some suggested improvements within this area but further developments are needed to ensure the desired fiber quality while at the same time providing a more energy efficient refiner blade.

SUMMARY

The object of the present invention is to eliminate or at least to minimize the problems discussed above. This is achieved by a blade for a refiner and by a refiner comprising such a blade according to the appended independent claims.

The blade according to the invention is delimited by an inner periphery and an outer periphery and comprises a blade surface with a refiner portion on which a plurality of refiner bars are arranged. Each refiner bar extends from an inner bar end to an outer bar end, and the plurality of refiner bars are angled so that a movement along a bar extension from an outer bar end to an inner bar end of a refiner bar is also a movement in a first circumferential direction. Furthermore, the blade comprises at least one dam that extends from an inner dam end to an outer dam end and connects at least three refiner bars, wherein the dam is angled so that a movement along a dam extension from an outer dam end to an inner dam end is also a movement in the first circumferential direction.

Thereby, the dam is arranged to efficiently lift lignocellulosic material into the refiner gap while at the same time minimizing flow restriction so that energy consumption during operation is decreased. This in turn enables the dams to feed the lignocellulosic material along the blade towards the outer periphery to ensure that a desired refining quality is achieved while at the same time decreasing wear and energy consumption since the dams are less hindering to the flow of material than known prior art solutions.

According to some embodiments, the at least one dam has a dam height that is substantially equal to a bar height of at least one of the bars that the dam intersects. This ensures that the dam is able to lift the lignocellulosic material to the refining gap to improve the refining quality.

According to other embodiments, the at least one dam has a dam height that is 20-99%, preferably 20-85% of a bar height of at least one of the refiner bars that said dam connects. Thereby, a subsurface dam is achieved that enables a flow of steam and also improves the flow of material across the dam.

In some embodiments, the blade comprises the dam with a dam height that is substantially equal to the bar height, and also comprises at least one dam with a dam height that is 20-99%, preferably 20-85% of a bar height of at least one of the refiner bars that said dam connects. Thereby, dams and subsurface dams can be combined as desired to improve the flow of lignocellulosic material and steam while at the same time enabling a high quality of refining.

Suitably, the blade also comprises a groove extending adjacent to the dam on a side of the dam facing the outer periphery. Thereby, a pumping transport of lignocellulosic material is enabled, where the material after passing over the dam can flow along the groove before entering a bar groove between refiner bars for further transport towards the outer periphery. This in turn improves energy efficiency and decreases wear of the refiner blade.

The groove may have a width that increases towards the inner dam end. Thereby, the lignocellulosic material is encouraged to enter the bar grooves as it passes along the groove.

Also, the groove suitably has a width at an upper end that is at least equal to a width of the dam. Thereby, the groove is wide enough that the flow of lignocellulosic material is improved. The width at the upper end is a distance from the outer side of the dam in the radial direction to a refiner bar at a point where the refiner bar starts to taper towards the blade surface.

Suitably, the groove has a depth that is at least equal to half the dam height of the dam adjacent the groove. Thereby, the groove is deep enough that the flow of lignocellulosic material is improved.

Suitably, the blade also comprises a reinforcement portion where the outer dam end is connected to a refiner bar, said reinforcement portion being arranged on the side of the dam facing the inner periphery. Thereby, wear is decreased so that the lifetime of the blade is increased.

Also, the outer dam end of a first dam and the inner dam end of a second dam may each be connected to the same bar, and the inner dam end of the second dam is closer to the inner periphery than the outer dam end of the first dam. Thereby, refiner grooves that are not crossed by dams are avoided so that lignocellulosic material is unable to flow across the blade without being lifted to the refining gap. Also, the dams are angled or curved to improve the transport of the lignocellulosic material.

Suitably, the outer dam end of a first dam and the outer dam end of an adjacent dam in a radial direction are each connected to different refiner bars in the first circumferential direction. Thereby, the dams have an overlap in the radial direction and this increases strength of the blade and distributes areas subjected to large wear across the blade to render the blade as a whole more robust.

In some embodiments, the blade is a blade portion having a central angle of 10°-360°. Where the blade is not circular, the blade portion may then be combined with a plurality of similar or identical blade portions to form a circular blade.

Also, there may be at least one portion lacking refiner bars. Thereby, lignocellulosic material may be transported across the blade without being refined except in the refiner portion.

The present invention also relates to a refiner for refining lignocellulosic material comprising at least one blade according to any embodiment of the invention.

Many additional benefits and advantages of the present invention will be readily understood by the skilled person in view of the detailed description below.

DRAWINGS

Figure 1B:
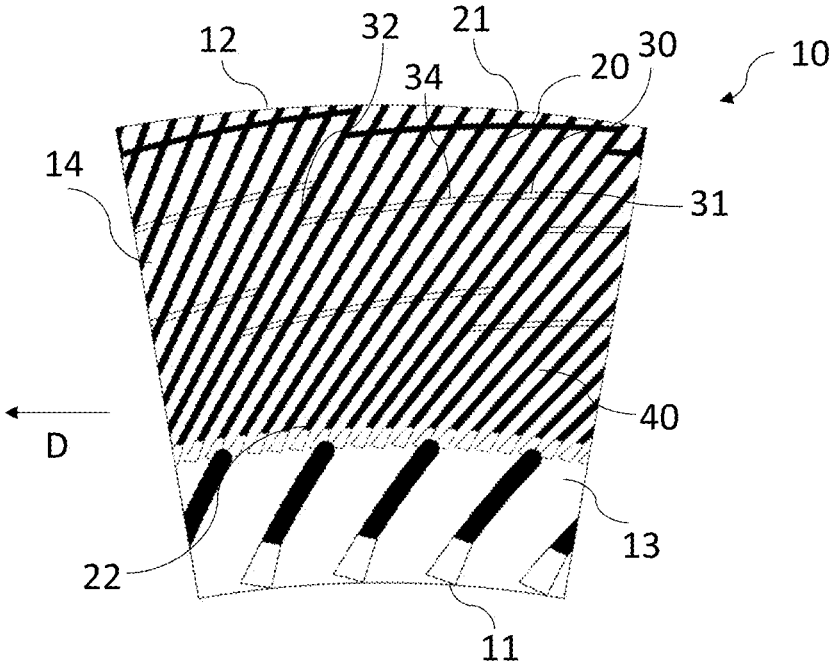
Figure 2A:
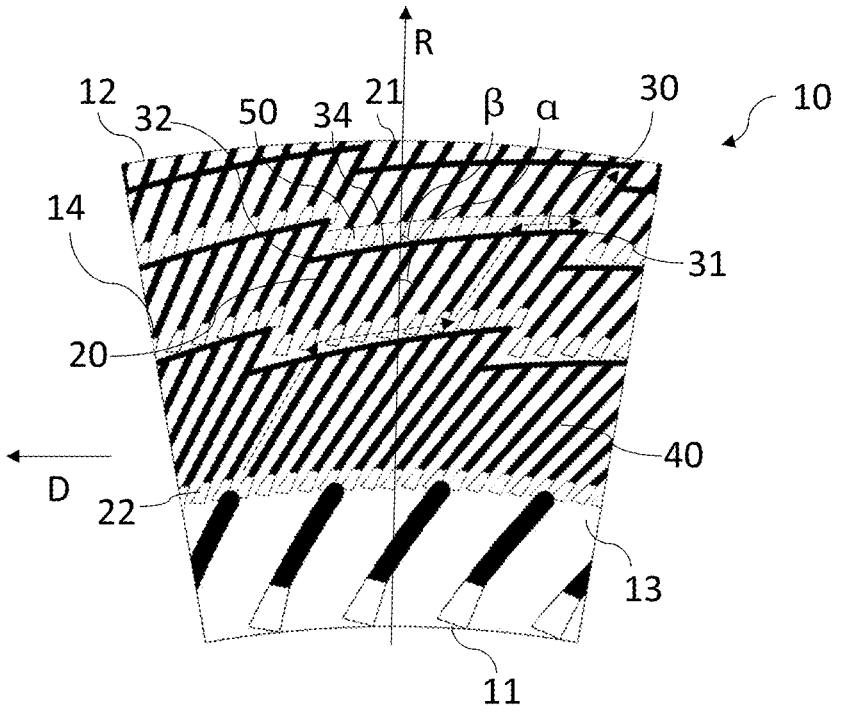
Figure 2B:
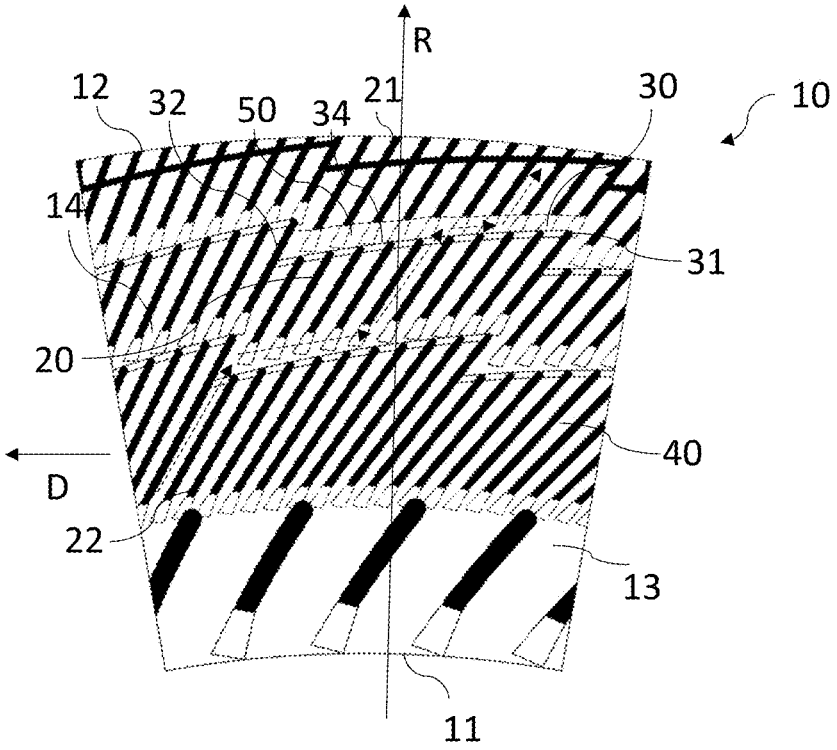
Figure 3A:
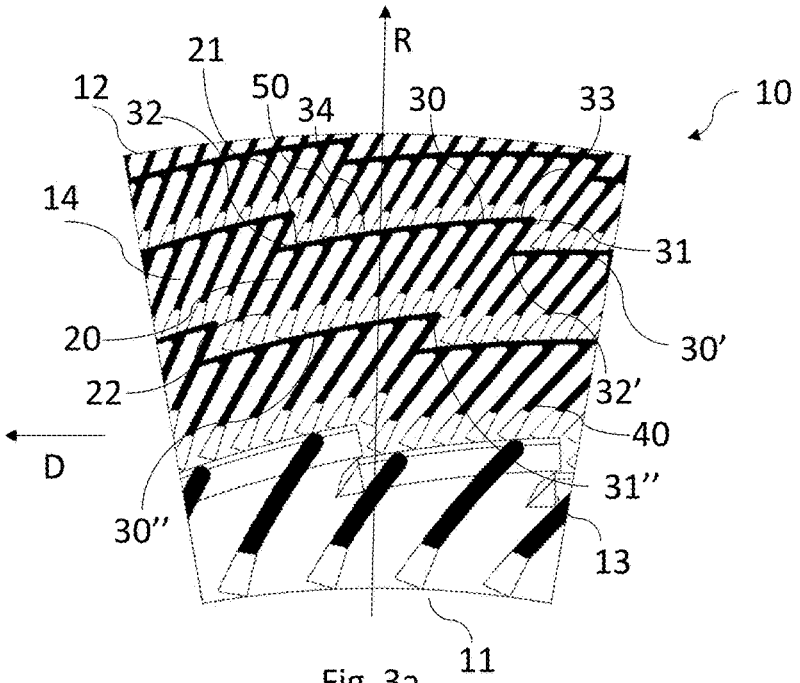
Figure 3B:
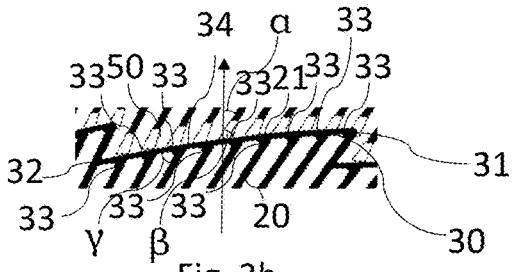

The invention will now be described in more detail with reference to the appended drawings, wherein FIG. 1*a* discloses a planar view from above of a blade according to a first embodiment of the invention;

FIG. 1*b* discloses a planar view from above of a blade according to a second embodiment of the invention;

FIG. 2*a* discloses a planar view from above of a blade according to a third embodiment of the invention;

FIG. 2*b* discloses a planar view from above of a blade according to a fourth embodiment of the invention;

FIG. 3*a* discloses a planar view from above of a blade according to a fifth embodiment of the invention;

FIG. 3*b* discloses an enlargement of one of the dams of FIG. 3*a;*

Figure 3C:
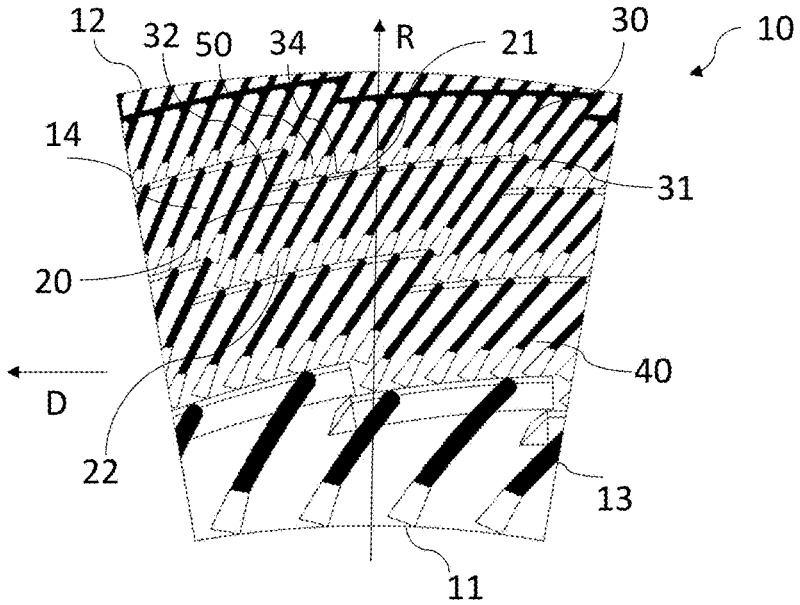
Figure 4:
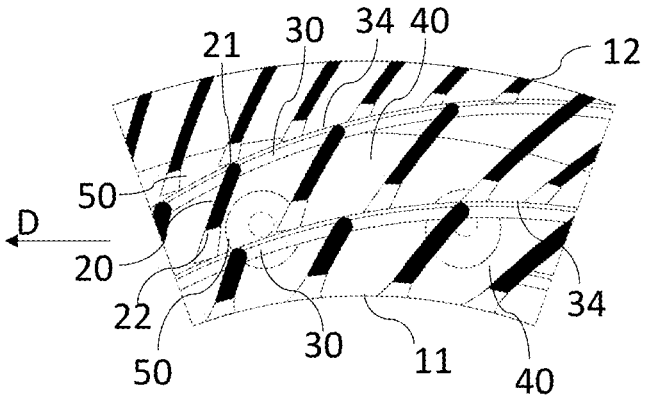
Figure 5:
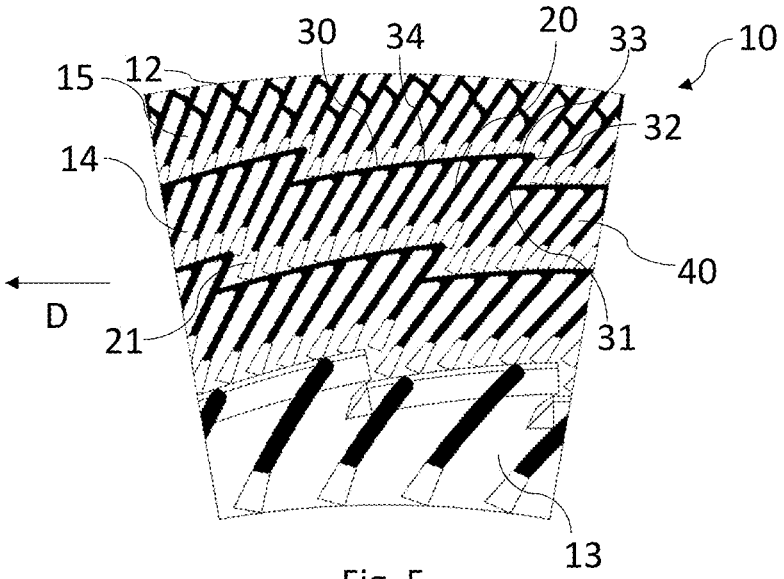
Figure 6:
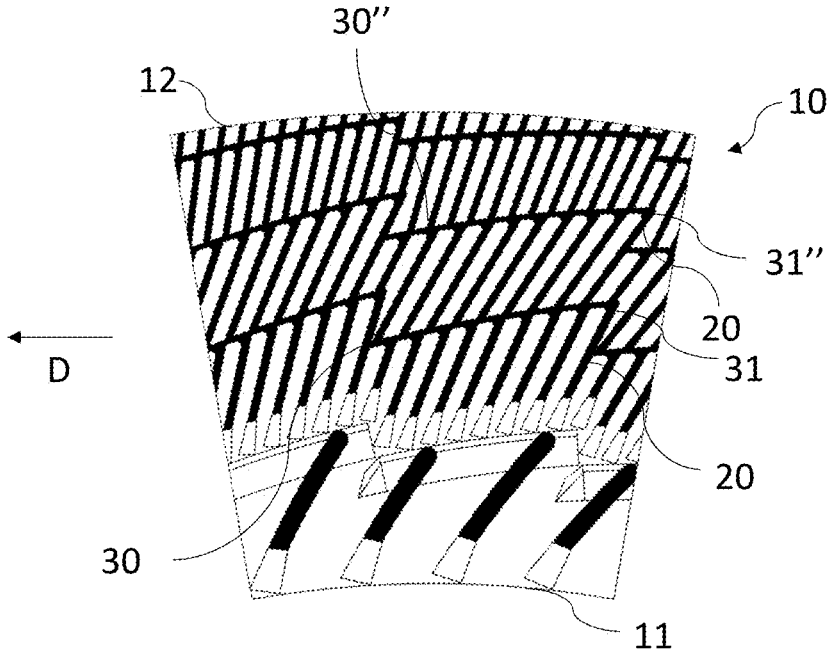
Figure 7A:
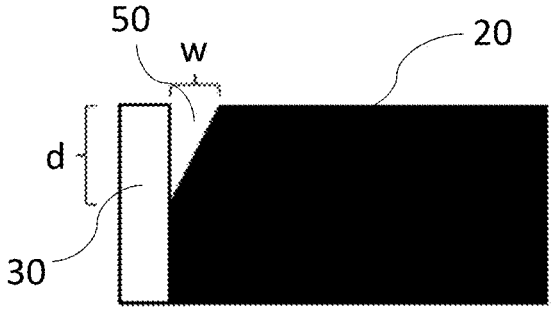

FIG. 3*c* discloses a planar view from above of a blade according to a sixth embodiment of the invention;

FIG. 4 discloses a planar view from above of an embodiment where the density of refiner bars differs in each set of refiner bars;

FIG. 5 discloses a planar view from above of an embodiment with an outer portion;

FIG. 6 discloses a planar view from above of an embodiment lacking grooves;

FIG. 7*a* discloses a schematic view from the side of a groove; and

Figure 7B:
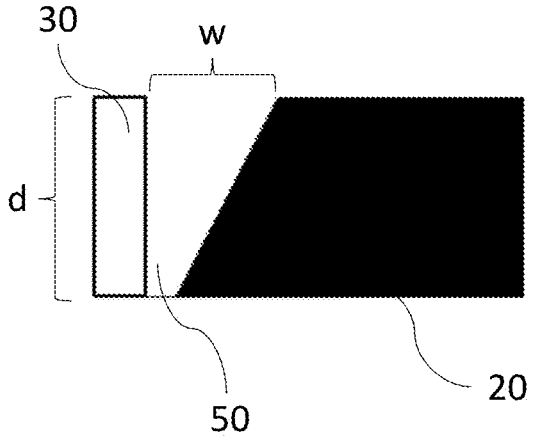

FIG. 7*b* discloses another schematic view from the side of a groove.

All the figures are schematic, not necessarily to scale, and generally only show parts which are necessary in order to elucidate the respective embodiments, whereas other parts may be omitted or merely suggested. Any reference number appearing in multiple drawings refers to the same object or feature throughout the drawings, unless otherwise indicated.

DETAILED DESCRIPTION

FIG. 1*a* discloses a blade 10 according to a first embodiment of the invention. The blade 10 shown in the Figures according to any embodiment of the invention may be a part of a circular blade of which only a portion is shown or may alternatively be a blade segment that is configured to be mounted together with a plurality of similar blade segments to form a circular blade.

When in use, the blade 10 is generally mounted in a disc refiner (not shown) and serves to refine lignocellulosic material by acting as a blade within a blade pair that are arranged to face each other, wherein at least one of the blades in the pair is arranged to rotate. Generally, a blade that is arranged to rotate in the disc refiner is referred to as a rotor side blade, whereas a blade that is arranged to be stationary is referred to as a stator side blade. When in use, a refiner gap is formed between the blades so that lignocellulosic material passing through the refiner gap is refined by refiner bars arranged on each of the blades.

The term lignocellulosic material is used herein to mean materials comprising cellulose and preferably also comprising lignin and hemicellulose. One example of such materials is wood, others include other agricultural or forestry wastes. When refining lignocellulosic material with a disc refiner, the material is generally fed into the disc refiner through an opening at a center of one of the blades and is refined while moving radially outwards between the blade pair. Lignocellulosic material may also refer to materials containing mainly cellulose, such as e.g. cotton.

The invention will be described with reference to various embodiments, and it is in particular to be noted that a feature from one embodiment may freely be introduced into another embodiment except where such a combination is explicitly stated as unsuitable or undesirable. Thus, the embodiments disclosed herein may be combined with each other as desired.

It is to be noted that each of the embodiments shown in the Figures is only a portion of a blade 10 and that the blade 10 itself may comprise additional portions both at the inner periphery 11, at the outer periphery 12 and on either sides of that shown in each Figure. Thus, the Figures are to be seen as embodiments having a pattern of refiner bars and dams that can be repeated across the entire blade 10 or that can be provided in only one portion of said blade 10.

The blade 10 shown in FIG. 1*a* is delimited by an inner periphery 11 and an outer periphery 12 and comprises a blade surface 13. On the blade surface 13 is at least one refiner portion 14 comprising a plurality of refiner bars 20 that extend upwards from the blade surface 13. The refiner portion 14 may extend across the entire blade surface 13 but in most embodiments the blade surface 13 also comprises other portions that do not include refiner bars 20. In FIG. 1*a*, the blade 10 is shown with a portion near the inner periphery 11 lacking refiner bars 20, and this may also be provided near the outer periphery 12 or in other parts of the blade surface 13.

The refiner bars 20 each comprise an outer bar end 21 and an inner bar end 22, wherein the outer bar end 21 is closer to the outer periphery 12 than the inner bar end 22. The refiner bars 20 are arranged so that a movement along a bar extension, i.e. a movement along an individual refiner bar 20, from the outer bar end 21 to the inner bar end 22 is also a movement in a first circumferential direction D. The first circumferential direction D is a rotational direction when the blade 10 is arranged in the refiner, and the first rotational direction D is further perpendicular to a radial direction R that is defined as a direction from a point on the inner circumference 11 to a point on the outer circumference 12 that is closest to the point on the inner circumference 11. That the movement along the bar extension is a movement in the first circumferential direction D is to be understood herein as the movement having a component that is directed in the first circumferential direction D. There may also be a component that is in a radial direction perpendicular to the first circumferential direction D.

The arrangement of the refiner bars 20 means that they are inclined with respect to the radial direction R to form a bar angle $\alpha$ in a clockwise direction that is less than 90°. In some embodiments, the refiner bars 20 are parallel to each other but in other embodiments at least one of them may be non-parallel to the others. Also, the refiner bars in some embodiments form straight lines but may in some embodiments be curved. Also, in some embodiments the refiner bars 20 may vary across the blade 10 so that some of them form straight lines while others are curved, and that some of them are parallel but other are not. At the inner bar end 22, the bars 20 preferably taper to the blade surface 13. The bar angle α may differ for each refiner bar 20, but is advantageously in the range of 5°-60°.

Also provided on the refiner portion 14 is at least one dam 30 that connects at least three refiner bars 20. Each dam 30 extends from an outer dam end 31 to an inner dam end 32, wherein the outer dam end 31 is closer to the outer periphery 12 than the inner dam end 32. The dam 30 is further arranged so that a movement along a dam extension, i.e. a movement along the individual dam 30, from the outer dam end 31 to the inner dam end 32 is also a movement in the first circumferential direction D. This means that the dam 30 is inclined with respect to the radial direction R to form a dam angle β in the clockwise direction that is less than 90°. The dam angle β may differ for each of the dams 30 but is advantageously in the range of 30°-85°. In embodiments where the dam 30 is curved, the dam angle β suitably decreases when moving from the outer dam end 31 towards the inner dam end 32.

Where the dam 30 is connected to a refiner bar 20, a connection angle γ is formed in a corner facing in the first circumferential direction D and facing the inner periphery 11. The connection angle γ is advantageously in the range 30°-85°, and this ensures an efficient refining of lignocellulosic material as well as a low energy consumption.

Preferably, the bar angle α may vary across the segment. It is advantageous to provide a larger bar angle α towards the center of the blade 10, i.e. towards the inner periphery 11 but to provide a smaller bar angle α when the bars are closer to the outer periphery 12. Also, the dam angle β may vary across the segment and it is advantageous to provide a smaller dam angle β near the inner periphery 11 but a larger dam angle β near the outer periphery 12. Thus, when moving across the blade 10 in the radial direction R from the inner periphery 11 to the outer periphery 12, the bar angle α preferably decreases whereas the dam angle β increases.

In the first embodiment, the refiner portion 14 comprises a plurality of dams 30 that are arranged in this way, but in other embodiments a single dam 30 may instead be provided. Also, the dams 30 shown in FIG. 1*a* are provided so that a group of refiner bars 20 are connected by more than one dam 30 where the dams 30 are arranged along the same refiner bars 20 but at different distances to the inner periphery 11. In other embodiments, the dams 30 may instead be arranged so that only some of the refiner bars 20 connected by one dam 30 are connected by another dam 30 closer to the inner periphery 11, or so that each refiner bar 20 is connected to only one dam 30.

Furthermore, in the embodiment of FIG. 1*a* all refiner bars 20 are connected by at least one dam 30 with a refiner bar 20 at the inner dam end 32 of one dam 30 also being at the outer dam end 31 of another dam 30. In other embodiments, some refiner bars 20 may be unconnected to any dam 30 or the placement of dams 30 may be varied as desired on the refining portion 14.

The dams 30 may further form straight lines or curves, and they may be parallel or non-parallel to each other as desired.

The arrangement of the bars 20 and the dams 30 with their inner bar end 22 and inner dam end 32 further along in the first circumferential direction D than the outer bar end 21 and the outer dam end 31 means that the dams 30 are able to raise the lignocellulosic material from bar grooves 40 into the refining gap to improve refining while at the same time enabling efficient transport of the lignocellulosic material across the blade 10 from the inner periphery 11 to the outer periphery 12. This in turn decreases energy consumption since the dams 30 are less of an obstacle to the flow of lignocellulosic material than dams 30 arranged with an angle of more than 90° to the radial direction R, i.e. dams inclined with their outer dam end further along in the first circumferential direction D.

In the embodiment of FIG. 1*a*, the at least one dam 30 has a dam height that is substantially equal to a bar height of at least one of the bars 20 that the dam 30 intersects. This means that the dam 30 lifts the cellulosic material all the way to the refining gap and prevents a flow of lignocellulosic material across the dam 30 that is not refined by the refiner bars 20. That the dam height is substantially equal to the bar height is to be understood as them being equal within manufacturing tolerances or at least not differing from each other more than 10% of their height from the blade surface 13. In the first embodiment, all the dams 30 have this dam height, but in other embodiments at least one of them could be lower. The dam height being substantially equal to a bar height is also advantageous in increasing pressure between the blades during refining.

FIG. 1*b* discloses a second embodiment that differs from the first embodiment by at least one of the dams 30 being a subsurface dam, i.e. a dam that has a dam height that is less than the bar height of at least one of the refiner bars 20 connected by the dam 30. In the second embodiment, the dam height is 20-99%, preferably 20-85% of a bar height of at least one of the refiner bars that said dam 30 connects. This has the advantage of facilitating a flow of steam in a direction opposite to the direction of flow of the lignocellulosic material when using the blade 10 according to the invention, since the dam 30 provides less of an obstacle for the flow in the bar grooves 40. At the same time, refining efficiency is still very close to that of the first embodiment described above, since most of the lignocellulosic material will be lifted to the refiner gap while high pressure steam that typically moves along the bar grooves 40 will be free to move and allowed to enter the bar grooves 40 on an outer side 34 of the dam 30. In the second embodiment of FIG. 1*b*, all of the dams 30 are subsurface dams, but in other embodiments some of them may have the full bar height as shown in FIG. 1*a*. In some embodiments, subsurface dams are particularly advantageous towards the outer periphery 12 where a reverse flow of steam takes place.

FIG. 2*a* discloses a third embodiment of the blade 10 that differs from the first and second embodiments by including a groove 50 that extends adjacent to the dam 30 on the outer side 34 of the dam 30, i.e. on the side of the dam 30 that faces the outer periphery 12. The groove 50 extends along the dam 30 and is long enough to pass at least three refiner bars 20. In some embodiments, the groove 50 extends along the entire dam 30, i.e. from the inner dam end 32 to the outer dam end 31. The groove 50 is delimited by the outer side 34 of the dam 30 and by the refiner bars 20 where they start tapering towards the blade surface 13 (indicated by dashed line in FIG. 2*a*-2*b*).

The groove 50 may be seen as an interruption of a refiner bar 20 that extends from the outer bar end 21 and tapers to the blade surface 13 at the groove 50 to then continue from the dam 30 towards the inner bar end 22. Alternatively, the groove 50 may be seen as providing an end for the refiner bars 20 that taper to the blade surface 13 so that this forms their inner bar ends 22. In the third embodiment, grooves 50 are provided for all the dams 30 but in other embodiments some of the dams 30 may lack grooves 50.

The groove 50 has the advantage of enabling a pumping transport of the lignocellulosic material across the blade 10 during use. This means that as the blade 10 rotates in the first circumferential direction D, lignocellulosic material travels in one of the bar grooves 40 to a dam 30, then is lifted to the refiner gap and travels along the groove 50 before entering another bar groove 40. This is shown by dashed arrows in FIG. 2*a*. Such transport increases energy efficiency of the refiner and decreases wear of the blade 10 to ensure a longer lifetime.

The groove 50 may have a width that increases from the outer dam end 31 towards the inner dam end 32, thereby encouraging the lignocellulosic material to enter the bar grooves 40 as it moves along the groove 50. The groove 50 further has a groove width at an upper end, i.e. an end farthest away from the blade surface 13, that is at least equal to an upper width of the dam 40. The groove width is further to be understood as a width in the radial direction R from the dam 30 to the refiner bar 20 on the outer side 34 of the dam 30. At the upper end of the groove 50, the refiner bar 20 is at its full height but suitably the refiner bar 20 tapers towards the outer side 34 of the dam 30 to decrease wear.

FIG. 2*b* discloses a fourth embodiment of the blade 10 that is similar to the third embodiment in that it comprises the groove 50 on the outer side 34 of the dam 30 but that is also similar to the second embodiment by at least some of the dams 30 being subsurface dams. The pumping transport of lignocellulosic material is further improved by the subsurface dams 30 that facilitates passage over the dam 30 to allow a flow of steam and so that energy consumption and wear on the dam 30 are reduced. The transport of lignocellulosic material is shown in dashed arrows similar to FIG. 2*a*.

FIG. 3*a* discloses a fifth embodiment of the blade 10 where the refiner bars 20 on one side of a groove 50 are not extensions of refiner bars 20 on the other side of the groove 50 but are instead arranged to differ in direction or inclination from each other. A density of the refiner bars 20, i.e. how many refiner bars 20 are provided on a surface portion of a given size, may also differ.

Also, the fifth embodiment comprises a reinforcement portion 33 on at least one dam 30, the reinforcement portion 33 being arranged where the outer dam end 31 is connected to the refiner bar 20. The reinforcement portion 33 is arranged on a side of the dam 30 facing the inner periphery 11, i.e. on an opposite side to the outer side 34. More specifically, the reinforcement portion 33 is arranged at a corner where the dam 30 meets the last refiner bar 20 at the outer dam end 31. The reinforcement portion 33 is thus arranged in a place where wear on the dam 30 from the lignocellulosic material is particularly high and therefore serves to protect the dam 30 and prolong the lifetime of the blade 10. Suitably, the reinforcement portion 33 is integrated with the dam 30 and the refiner bar 20, but in some embodiments, it could instead be a separate portion that is added to the corner between the dam 30 and the refiner bar 20 at the outer dam end 31 during manufacture.

In the fifth embodiment, at least one of the dams 30 also comprises reinforcement portions 33 at more than one intersection of the dam 30 and a refiner bar 20, and this is particularly advantageous in decreasing wear on the dam 30 as a whole. Other embodiments may comprise the reinforcement portion 33 only at the outer dam end 31.

FIG. 3*b* discloses an enlargement of the dam 30 of the blade 10 according to FIG. 3*a*, where reinforcement portions 33 are provided at each intersection between the dam 30 and one of the refiner bars 20, more specifically at corners of such intersections facing in the first circumferential direction D since these are the corners where wear will be at its highest due to the rotation of the blade 10 when in use.

FIG. 3*c* discloses a sixth embodiment that is similar to the fifth embodiment except that at least some of the dams 30 are subsurface dams 30. The reinforcement portions 33 of the fifth embodiment may be included at at least one intersection of the dam 30 and one of the refiner bars 20, preferably at least the refiner bar 20 at the outer dam end 31. However, reinforcement portions 33 are not shown in FIG. 3*c*.

In the embodiments of FIGS. 3*a* and 3*c*, the outer dam end 31 of a first dam 30 and the inner dam end 32' of a second dam 30' are connected to the same refiner bar 20. The inner dam end 32' of the second dam 30' is closer to the inner periphery 11 than the outer dam end 31 of the first dam 30. This ensures that transport of lignocellulosic material across the blade 10 is efficient and with low energy consumption.

In the embodiments of FIG. 3*a*-3*c*, the outer dam end 31 of a first dam 30 and the outer dam end 31" of an adjacent dam 30" in the radial direction perpendicular to the first circumferential direction D are each connected to different refiner bars 20. This means that there is an overlap of the dams 30, 30" at the outer dam ends 31, 31" in the first circumferential direction D. In other words, the outer dam end 31 of the first dam 30 is offset in the first circumferential direction D from the outer dam end 31" of the adjacent dam 30". The benefit of this arrangement is that the flow of lignocellulosic material and steam will cause wear on the dams 30, 30" in particular at the outer dam end 31, 31", and by distributing the outer dam ends 31, 31" in this manner the wear on the blade is also distributed more evenly than in embodiments where the outer dam ends 31 of multiple dams 30 are connected to the same refiner bar 20 or to refiner bars that are arranged as extensions of each other (see e.g. FIG. 2*a*).

FIG. 4 discloses an embodiment where the density of refiner bars 20 differs in each set of refiner bars from the inner periphery 11 to the outer periphery 12. Also, the dams 30 are shown as subsurface dams 30 and grooves 50 are provided on the outer side 34 of each dam 30.

FIG. 5 discloses an embodiment with an outer portion 15 that is provided on the blade surface 13 between the refiner surface 14 and the outer periphery 12. In the outer portion 15, refiner bars and dams are provided for additional refining of the lignocellulosic material after it has passed the refiner surface 14 with refiner bars 20 and dams 30 arranged according to the present invention.

As mentioned above, the blade 10 may be a circular blade but it may alternatively be a blade portion having a central angle of 10°-360°. A plurality of blade portions can then be mounted in a refiner to form a circular blade.

The refiner portion 14 may extend across the entire blade surface 13 from the inner periphery 11 to the outer periphery 12. Alternatively, there may be other portions on the blade surface 13, such as the outer portion 15 disclosed above and in FIG. 5. There may also be such portions comprising refiner bars that are arranged between the refiner portion 14 and the inner periphery 11. Also, there may be at least one portion on the blade surface 13 that lacks refiner bars, and such a portion may be arranged close to the inner periphery 11, close to the outer periphery 12, or at any other part of the blade surface 13. Also, in some embodiments there may be two or more refiner portions 14 according to the present invention on the blade surface 13 with another portion either comprising refiner bars or lacking refiner bars between them.

FIG. 6 discloses an embodiment of the invention that lacks the groove 50 and where angle of the refiner bars 20 vary across the blade 10.

FIG. 7*a* discloses a groove 50 adjacent to a dam 30. The groove 50 has a groove width w that is at least the width of the adjacent dam 30 but that may be significantly larger. Furthermore, the groove 50 has a depth d of at least half the dam height of the adjacent dam 30. In FIG. 7*a*, the groove 50 has the groove width equal to the width of the adjacent dam 30, and also a depth d that is equal to half the dam height of the dam 30. The depth d of the groove 50 is described in relation to an adjacent refiner bar 20, i.e. the refiner bar 20 that starts tapering at the groove 50. So said depth d is a depth from an upper end of the adjacent refiner bar 20, whereas the dam height is a height from a bar groove 40 adjacent to the dam 30. FIG. 7*b* discloses a groove 50 with a groove width w that is larger than the width of the dam 30 and a depth that is equal to the dam height of the dam 30. In other embodiments, the dimensions of the groove 50 may vary so that the groove width is equal to the depth, or alternatively that the groove width and the depth differ from each other in any suitable way as long as they are larger than the minimum dimensions shown in FIG. 7*a*.

The present invention also relates to a refiner that comprises at least one blade 10 according to any embodiment of the invention as disclosed herein. Said refiner may in some embodiments comprise two blades 10 according to the invention, with one of them arranged as the rotor side blade and the other as the stator side blade. In other embodiments, one blade 10 according to the invention may be arranged together with a refiner blade according to the prior art as either the rotor side blade or the stator side blade.

It is to be noted that features from the various embodiments described herein may freely be combined, unless it is explicitly stated that such a combination would be unsuitable.

The invention claimed is:

1. A blade for a refiner for refining lignocellulosic material, the blade being delimited by an inner periphery and an outer periphery and comprising:

a blade surface with a refiner portion on which a plurality of refiner bars are arranged, wherein:

each refiner bar extends from an outer bar end to an inner bar end, and the plurality of refiner bars are arranged so that a movement along a bar extension from an outer bar end to an inner bar end of a refiner bar is also a movement in a first circumferential direction;

a dam that extends from an outer dam end to an inner dam end and connects at least three refiner bars that are parallel with each other, and wherein the dam is arranged so that a movement along a dam extension from an outer dam end to an inner dam end is also a movement in the first circumferential direction; and a groove extending from the outer dam end to the inner dam end and adjacent to the dam on an outer side of the dam, said outer side being a side that faces the outer periphery.

2. The blade according to claim 1, wherein the dam has a dam height that is substantially equal to a bar height of at least one of the refiner bars that the dam intersects.

3. The blade according to claim 1, wherein the at least one dam has a dam height that is 20-99% of a bar height of at least one of the refiner bars that said dam connects.

4. The blade according to claim 2, wherein the blade also comprises at least one dam with a dam height that is 20-99% of a bar height of at least one of the refiner bars that said dam connects.

5. The blade according to claim 1, wherein the groove has a width that increases towards the inner dam end.

6. The blade according to claim 1, wherein the groove has a width at an upper end that is at least equal to a width of the dam.

7. The blade according to claim 1, wherein the groove has a depth that is at least equal to half the dam height of the dam adjacent the groove, said depth being a depth from an upper end of an adjacent refiner bar.

8. The blade according to claim 1, further comprising a reinforcement portion where the outer dam end is connected to a refiner bar, said reinforcement portion being arranged on a side of the dam facing the inner periphery.

9. The blade according to claim 1, wherein the outer dam end of a first dam and the inner dam end of a second dam are each connected to the same refiner bar, and wherein the inner dam end of the second dam is closer to the inner periphery than the outer dam end of the first dam.

10. The blade according to claim 1, wherein the outer dam end of a first dam and the outer dam end of an adjacent dam in a radial direction are each connected to different refiner bars in the first circumferential direction.

11. The blade according to claim 1, wherein the blade is a blade portion having a central angle of 10°-360°.

12. The blade according to claim 1, further comprising at least one portion lacking refiner bars.

13. A refiner for refining lignocellulosic material, the refiner comprising at least one blade according to claim 1.

* * * * *